US006152774A

United States Patent [19]

Yu

[11] Patent Number: 6,152,774

[45] Date of Patent: Nov. 28, 2000

[54] ELECTRICAL CARD CONNECTOR

[75] Inventor: Hung-Chi Yu, Hsi-Chih, Taiwan

[73] Assignee: Hon Hai Precision Ind. Co., Ltd., Taipei Hsein, Taiwan

[21] Appl. No.: 09/393,766

[22] Filed: Sep. 10, 1999

[30] Foreign Application Priority Data

Dec. 24, 1998 [TW] Taiwan ..... 87221550

[51] Int. Cl.[7] ..... H01R 13/648

[52] U.S. Cl. ..... 439/607

[58] Field of Search ..... 439/607–610, 439/64, 159, 541.5

[56] References Cited

U.S. PATENT DOCUMENTS 5,660,558 8/1997 Osanai et al. ..... 439/607
5,662,482 9/1997 Shin ..... 439/541.5
5,738,544 4/1998 Davis ..... 439/607
5,795,190 8/1998 Ono ..... 439/607
5,967,813 10/1999 Ho et al. ..... 439/159
5,967,845 10/1999 Ho et al. ..... 439/607

*Primary Examiner*—Gary F. Paumen
*Attorney, Agent, or Firm*—Wei Te Chung

[57] ABSTRACT

An electrical card connector comprises an insulative housing, a plurality of contacts received in the housing, a shield mounted on the housing and a card ejector mechanism assembled on a side of the shield. The housing comprises a base, a pair of arms disposed on opposite ends of the base and a chamber defined between the arms. Each arm forms a pair of blocks on an outer surface thereof and defines a recess in a top face thereof. The shield forms a pair of engaging tabs on opposite sides thereof. Each engaging tab defines a hole corresponding to the blocks of the housing. The holes of the tabs engagably receive the blocks of the housing thereby securing the shield onto the housing.

2 Claims, 4 Drawing Sheets

ELECTRICAL CARD CONNECTOR

BACKGROUND OF THE INVENTION

The present invention relates to an electrical card connector, and especially to a PCMCIA card connector having a shield facilitatively assembled to an insulative housing thereof.

DESCRIPTION OF THE PRIOR ART

U.S. Pat. No. 5,662,482 and Taiwan Patent Application No. 86210606 each disclose an electrical card connector. Referring to FIG. 1, a conventional electrical card connector 9 comprises an insulative housing 91, and a first shield 90 and a second shield 92 mounted on opposite surfaces of the housing 91. The first shield 90 forms a pair of tabs 901 on opposite edges thereof. Each tab 901 defines a hole 902. The second shield 92 defines a pair of holes 921 corresponding to the holes 902. The housing 91 defines a pair of recesses 911 and a pair of through holes 912 corresponding to the tabs 901 of the first shield 90. In assembly, the first and second shields 90, 92 are downwardly and upwardly assembled to the housing 91 with the tabs 901 received in the recesses 911. A pair of bolts 96 is upwardly inserted into the holes 921, the through holes 912 and the holes 902. A pair of nuts 95 is disposed in the recesses 911 to engage with the bolts 96 thereby securing the first and second shields 90, 92 onto the housing 91. However, assembly of the bolts 96 and the nuts 95 is laborious and increase costs. Hence, an improved electrical card connector is required to overcome the disadvantages of the prior art.

BRIEF SUMMARY OF THE INVENTION

An object of the present invention is to provide an electrical card connector comprising a shield facilitatively mounted on an insulative housing thereof.

Accordingly, an electrical card connector comprises an insulative housing, a plurality of contacts received in the housing, a shield mounted on the housing and a card ejector mechanism assembled on a side of the shield. The housing comprises a base, a pair of arms disposed on opposite ends of the base and a chamber defined between the arms. Each arm forms a pair of blocks on an outer surface thereof and defines a recess in a top face thereof. The shield forms a pair of engaging tabs on opposite sides thereof. Each engaging tab defines a hole corresponding to the blocks of the housing. The holes of the tabs engagably receive the blocks of the housing thereby securing the shield onto the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
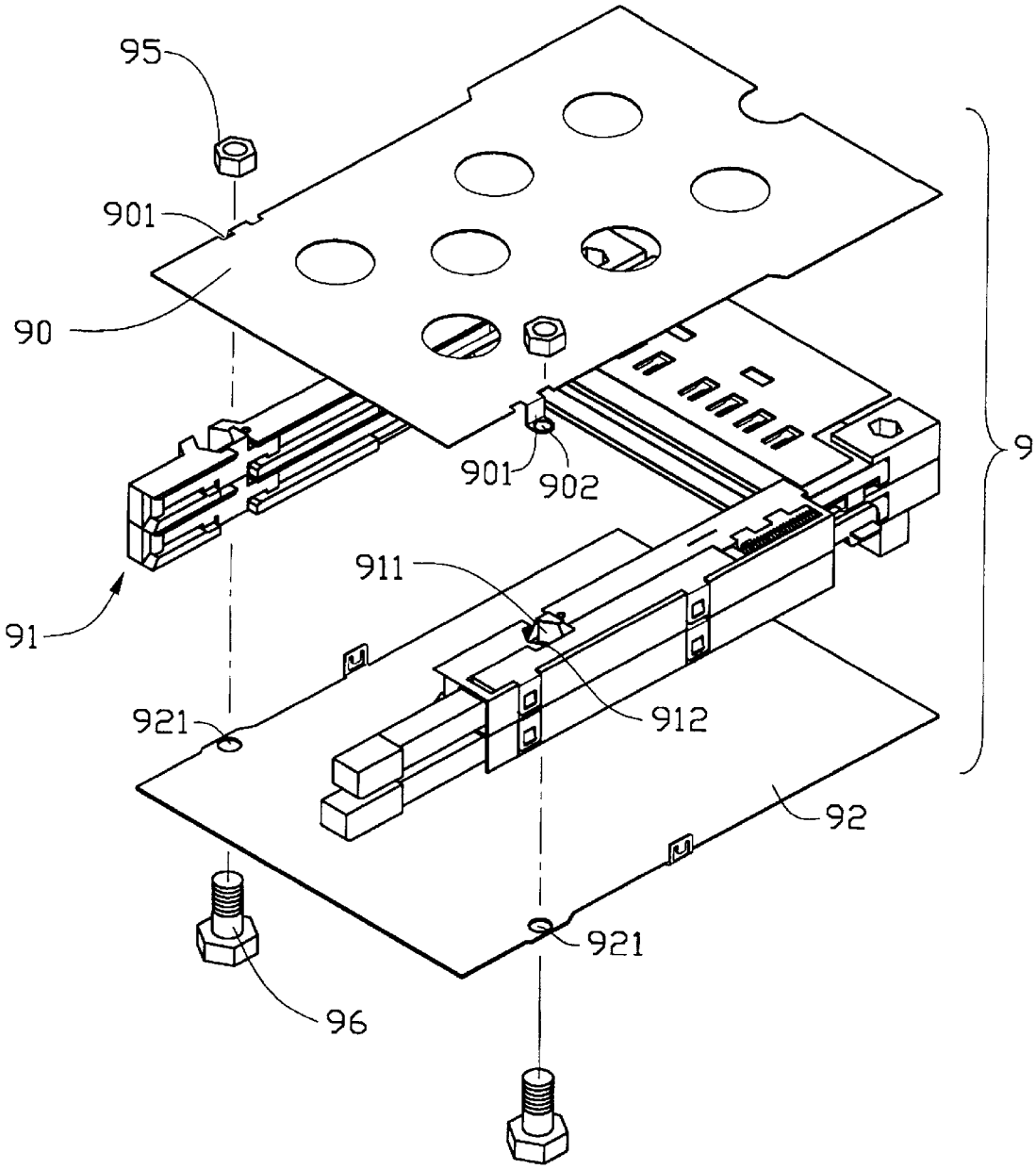
FIG. 1 (PRIOR ART)
FIG. 1 is an exploded view of a conventional electrical card connector.
Figure 2:
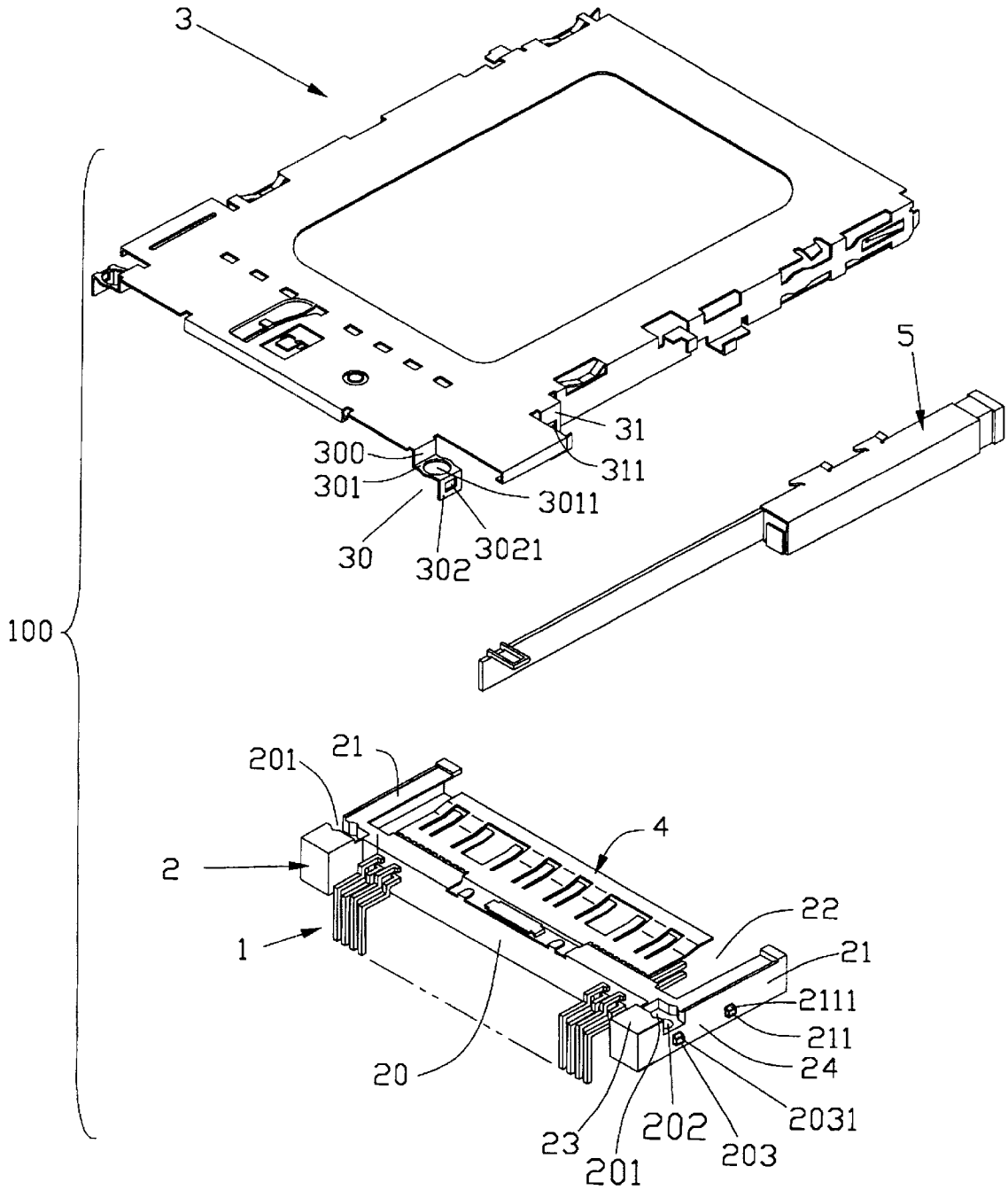
FIG. 2 is an exploded view of an electrical card connector of the present invention.
Figure 3:
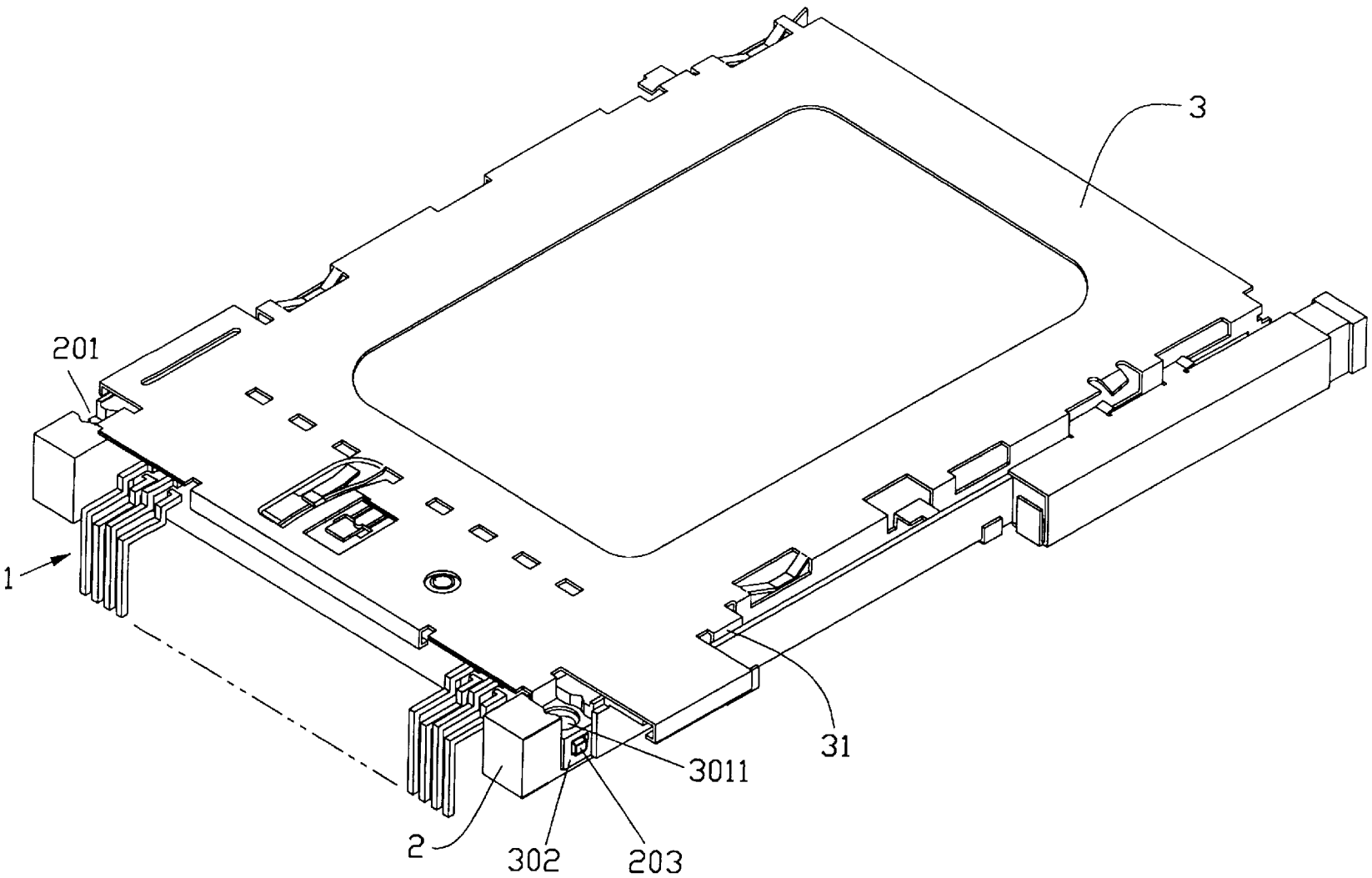
FIG. 3 is an assembled view of FIG. 2.

Referring to FIGS. 2 and 3, an electrical card connector 100 of the present invention comprises an insulative housing

2, a plurality of contacts 1 received in the housing 2, a shield 3, a grounding shell 4 mounted on the housing 2 and a card ejector mechanism 5 disposed on a side of the shield 3. The housing 2 comprises a base 20, a pair of arms 21 disposed on opposite distal ends of the base 20 and a chamber 22 defined between the arms 21 for accommodating a memory card (not shown). Each arm 21 defines a recess 201 and a central hole 202 communicating with the recess 201 in a top face 23 of the arm 21. The recess 201 is proximate to the distal end of the base 20. Each arm 21 forms a first block 203 and a second block 211 on a side face 24 thereof. The first block 203 is proximate to the recess 201 and the second block 211 is spaced a predetermined distance from the first block 203. Each block 203, 211 has an inclined top face 2031, 2111 for facilitating engagement of the shield 3 with the base 2.

The shield 3 forms two pairs of engaging tabs 30, 31 on opposite sides thereof corresponding to the blocks 203, 211 of the housing 2. The tab 30 is bent three times to sequentially form a first vertical portion 300, a horizontal portion 301 and a second vertical portion 302. The horizontal portion 301 and the second vertical portion 302 respectively define holes 3011, 3021 corresponding to the central hole 202 and the block 203 of the housing 2. Each engaging tab 31 defines a hole 311 corresponding to the second block 211.

Figure 4:
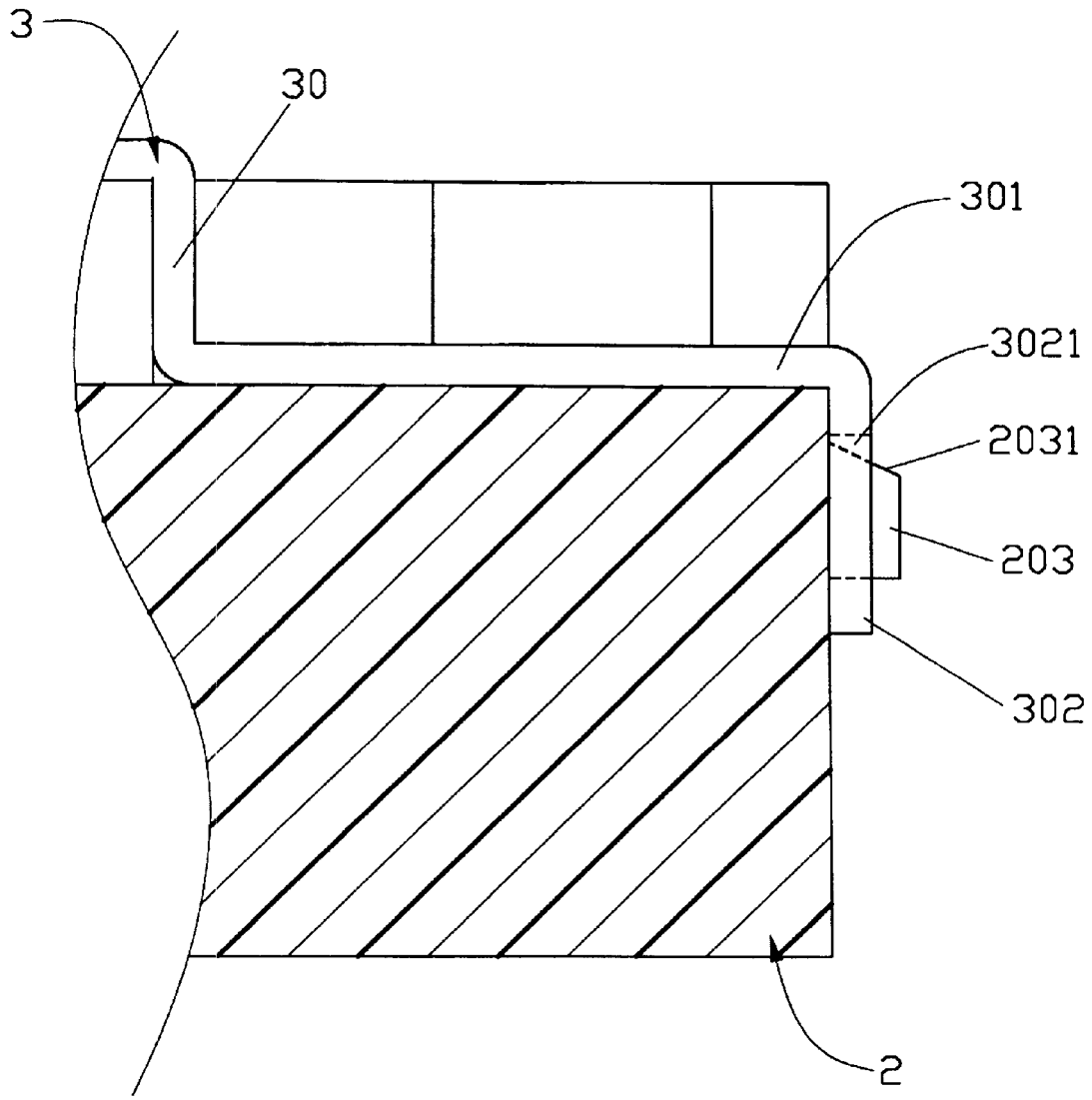
FIG. 4 is a partial, cross-sectional view of FIG. 3.

Also referring to FIG. 4, in assembly, the shield 3 is downwardly mounted on the housing 2 and the engaging tabs 30, 31 resiliently engage with the corresponding arm 21. The horizontal portion 301 of the engaging tab 30 is received in the recess 201. The second vertical portion 302 abuts against the side face 24 of the arm 21 and the hole 3021 receives the first block 203. The hole 311 of the engaging tab 31 receives the second block 211.

Since the shield 3 is mounted onto the housing 2 by the engaging tabs 30, 31, extra components such as nuts or bolts are omitted therefrom thereby facilitating assembly process of the shield 3 with the housing 2 and reducing manufacturing costs of the electrical card connector 100. The engaging tabs 30, 31 are formed during manufacture of the shield 3, which further reduces costs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector adapted for electrically connecting a memory card with a printed circuit board, comprising:

an insulative housing including a base and a pair of arms disposed on opposite distal ends of the base, a chamber being defined between the arms for receiving the memory card, each arm forming a block;

a plurality of contacts received in the base of the housing; and a shield mounted on the housing, the shield providing a pair of engaging tabs corresponding to the blocks of the arms, each engaging tab defining a hole, the blocks of the arms being received in corresponding holes of the engaging tabs thereby securing the shield onto the housing;

wherein the block of each arm is disposed on an outer surface thereof;

wherein the housing defines a recess in a top surface of each arm, each recess being proximate to the block of the same arm;

wherein each engaging tab is bent three times to sequentially form a first vertical portion, a horizontal portion and a second vertical portion, the hole being defined in the second vertical portion and the horizontal portion being received in the corresponding recess of the arm;

further comprising a card ejector mechanism assembled on a selected side of two sides of the shield.

2. The electrical card connector as claimed in claim 1, wherein each block has an inclined top face for facilitating engagement of the corresponding engaging tabs with therewith.

* * * * *